US008746871B2

(12) United States Patent
Chiwata

(10) Patent No.: US 8,746,871 B2
(45) Date of Patent: Jun. 10, 2014

(54) IMAGE FORMATION DEVICE AND IMAGE FORMATION METHOD

(75) Inventor: Yuhei Chiwata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 140 days.

(21) Appl. No.: 13/298,293

(22) Filed: Nov. 17, 2011

(65) Prior Publication Data

US 2012/0154498 A1 Jun. 21, 2012

(30) Foreign Application Priority Data

Dec. 16, 2010 (JP) ..... 2010-280868

(51) Int. Cl.
*B41J 2/01* (2006.01)

(52) U.S. Cl.
USPC ..... 347/102

(58) Field of Classification Search
None
See application file for complete search history.

(56) References Cited

U.S. PATENT DOCUMENTS 6,550,909 B2 * 4/2003 Ichinose et al. ..... 347/105
7,175,259 B2 * 2/2007 Aoshima ..... 347/55
7,580,659 B2 * 8/2009 Miyabe et al. ..... 399/285
7,728,860 B2 * 6/2010 Kawahara et al. ..... 347/224
7,840,155 B2 * 11/2010 Miyabe et al. ..... 399/91
7,845,786 B2 * 12/2010 Konno ..... 347/102

FOREIGN PATENT DOCUMENTS

JP 2006-142613 A 6/2006
JP 2009-166262 A 7/2009
JP 2010-512256 A 4/2010

* cited by examiner

*Primary Examiner* — Alessandro Amari
*Assistant Examiner* — Alexander C Witkowski
(74) *Attorney, Agent, or Firm* — SOLARIS Intellectual Property Group, PLLC

(57) ABSTRACT

An image formation device includes an inkjet head that ejects ink onto a sheet, IR heaters that dry the ink ejected on the sheet, and warm air heaters between the IR heaters. At the IR heaters, a peak wavelength of infrared rays is set to be less than or equal to 1.2 μm. By adjusting temperature of the IR heaters and temperature and wind speed of the warm air heaters, during an initial stage of drying in which a moisture content derived from ink at the sheet is greater than or equal to 4.0 g/m$^2$, heating is carried out under a condition that a paper surface temperature of the sheet becomes less than or equal to 100° C., and, after the moisture content derived from ink at the sheet becomes lower than 4.0 g/m$^2$, heating is carried out such that the paper surface temperature of the sheet exceeds 100° C.

10 Claims, 5 Drawing Sheets

IMAGE FORMATION DEVICE AND IMAGE FORMATION METHOD

CROSS-REFERENCE TO RELATED APPLICATION

This application claims priority under 35 USC 119 from Japanese Patent Application No. 2010-280868, filed on Dec. 16, 2010, the disclosure of which is incorporated by reference herein.

BACKGROUND OF THE INVENTION

1. Field of the Invention

The present invention relates to an image formation device and an image formation method that form an image by ejecting droplets onto a recording medium.

2. Description of the Related Art

Image formation devices that eject ink drops from an inkjet recording head onto a recording medium such as a sheet is conventionally known.

In such an image formation device, when high-speed image formation is carried out by using a linear inkjet recording head having the width of a page for example, a heating and drying process is needed after the ink drawing process, in order to ensure the rub-fastness of the image surface of the sheet and to reduce deformation of the sheet caused by moisture in the ink.

Japanese Patent Application Laid-Open (JP-A) No. 2006-142613 discloses a device that heats and dries ink drops, that have been ejected onto a recording medium, by an n near-infrared flash lamp of a wavelength of 700 nm to 1000 nm.

Further, JP-A No. 2010-512256 discloses a device that heats and dries ink, that has been ejected onto a sheet base material, by an near-infrared lamp (an IR LED array or an NIR array or the like) of a wavelength of 750 nm to 1400 nm.

Moreover, JP-A No. 2009-166262 discloses a device in which the ink contains heat-fusible particles of a fusing temperature of 40° C. to 130° C., and that, after image drawing, heats the surface on which the image is drawn to greater than or equal to 40° C. to 130° C. by a non-contact type infrared heater or by a contact heating film.

In an image formation device, heating by an infrared heater in particular is preferable from the standpoint of the drying efficiency. However, when carrying out heating by using an infrared heater, thermal damage of the sheet at the non-image portions becomes problematic. Namely, the moisture contained in the sheet is volatilized by heating of the blank portions, and sheet shrinkage of the non-image portions occurs, and cockling (undulations) or wrinkles may be brought about.

Further, when attempts are made to apply inkjet recording to commercial printing fields, adaptability to general-purpose coated paper that is used in offset printers and the like is required. However, when the drying technique described above is applied to general-purpose coated paper, protrusions of the image surface called blisters (or burn blisters) may arise.

SUMMARY OF THE INVENTION

In consideration of the aforementioned, the present invention provides an image formation device and an image formation method that can suppress blisters while reducing deformation of a recording medium.

A first aspect of the present invention is an image formation device that includes: a droplet ejecting device that ejects droplets onto a recording medium; and a drying device that dries droplets ejected onto the recording medium, the drying device including an infrared heater at which a peak wavelength of infrared rays is set to be less than or equal to 1.2 μm; wherein: during a first stage of drying, using the drying device, in which a moisture content derived from the droplets at the recording medium is greater than or equal to 4.0 g/m$^2$, heating is carried out under a condition that a paper surface temperature of the recording medium becomes less than or equal to 100° C.; and a second stage of drying, using the drying device, in which after the moisture content derived from the droplets at the recording medium becomes lower than 4.0 g/m$^2$, heating is carried out such that the paper surface temperature of the recording medium exceeds 100° C.

In accordance with the first aspect of the present invention, the drying device includes an infrared heater at which a peak wavelength of infrared rays is set to be less than or equal to 1.2 μm. Therefore, it is difficult for the infrared rays to be absorbed by the recording medium, thermal damage to the recording medium is reduced, and the occurrence of cockling (undulations) and wrinkles at the recording medium is reduced. Further, in the first stage of drying in which the moisture content derived from droplets at the recording medium is greater than or equal to 4.0 g/m$^2$, heating is carried out under the condition that the paper surface temperature of the recording medium becomes less than or equal to 100° C. In the second stage of drying, after the moisture content derived from droplets at the recording medium becomes lower than 4.0 g/m$^2$, heating is carried out such that the paper surface temperature of the recording medium exceeds 100° C. Due thereto, thermal damage to the recording medium is reduced, and the occurrence of cockling and wrinkles at the recording medium is reduced. Together therewith, sudden evaporation, due to heating, of the moisture that has penetrated into the recording medium is suppressed, and the occurrence of protrusions of the image surface called blisters (or burn blisters) at the recording medium is suppressed.

A second aspect of the present invention is an image formation device according to the first aspect, wherein the recording medium is a general-purpose coated paper for printing applications.

According to the second aspect described above, even when the recording medium is a general-purpose coated paper for printing applications at which blisters may arise easily, thermal damage to the recording medium is reduced, and the occurrence of cockling and wrinkles at the recording medium is reduced. Further, sudden evaporation, due to heating, of the moisture that has penetrated into recording medium is suppressed, and the occurrence of protrusions of the image surface called blisters at the recording medium is suppressed.

A third aspect of the present invention is an image formation device according to the first or second aspect of the present invention, wherein the droplets are ink, and an ink agglomerating processing liquid is applied to the recording medium before the droplets are ejected onto the recording medium.

In accordance with the invention of the above-described third aspect, the droplets are ink, and, by applying an ink agglomerating processing liquid to the recording medium before the droplets are ejected onto the recording medium, the pigments and the like that are dispersed within the ink agglomerate, and separation thereof from the solvent is promoted. Due thereto, the penetration of moisture into the recording medium is suppressed, and the occurrence of cockling at the sheet is suppressed.

A fourth aspect of the present invention is an image formation device according to any of the first through third aspects of the present invention, in which plural particles formed from thermoplastic resin are contained in the droplets.

According to the fourth aspect described above, due to numerous particles that are formed from thermoplastic resin being contained in the droplets, the resin is formed into a coating film when heated by the drying device, and the film surface quality improves.

A fifth aspect of the present invention is an image formation method that includes: ejecting droplets onto a recording medium; and a drying process whereby the droplets ejected onto the recording medium are exposed to an infrared heater at which a peak wavelength of infrared rays is set to be less than or equal to 1.2 μm; wherein the drying process includes: during a first stage of drying in which a moisture content derived from the droplets at the recording medium is greater than or equal to 4.0 $g/m^2$, carrying out heating under a condition that a paper surface temperature of the recording medium becomes less than or equal to 100° C.; and a second stage of drying in which after the moisture content derived from the droplets at the recording medium becomes lower than 4.0 $g/m^2$, carrying out heating such that the paper surface temperature of the recording medium exceeds 100° C.

According to the fifth aspect described above, when drying the droplets ejected onto the recording medium, thermal damage to the recording medium is reduced, and the occurrence of cockling and wrinkles at the recording medium is reduced. Further, sudden evaporation, due to heating, of the moisture that has penetrated into the recording medium is suppressed, and the occurrence of protrusions of the image surface called blisters (or burn blisters) at the recording medium is suppressed.

A sixth aspect of the present invention is an image formation method according to the fifth aspect of the present invention, wherein the recording medium is a general-purpose coated paper for printing applications.

According to the sixth aspect, even when the recording medium is a general-purpose coated paper for printing applications at which blisters may arise easily, thermal damage to the recording medium is reduced, and the occurrence of cockling and wrinkles at the recording medium is reduced. Further, sudden evaporation, due to heating, of the moisture that has penetrated into recording medium is suppressed, and the occurrence of protrusions of the image surface called blisters at the recording medium is suppressed.

A seventh aspect of the present invention is an image formation method according to the fifth or sixth aspect of the present invention, wherein the droplets are ink, and an ink agglomerating processing liquid is applied to the recording medium before the droplets are ejected onto the recording medium.

According to the above-described seventh aspect described above, the droplets are ink, and, by applying an ink agglomerating processing liquid to the recording medium before the droplets are ejected onto the recording medium, the pigments and the like that are dispersed within the ink agglomerate, and separation thereof from the solvent is promoted. Due thereto, the penetration of moisture into the recording medium is suppressed, and the occurrence of cockling at the sheet is suppressed.

An eighth aspect of the present invention is an image formation method according to any of the fifth through seventh aspects of the present invention, wherein plural particles formed from thermoplastic resin are contained in the droplets in any of the fifth through seventh aspects of the present invention.

According to the eighth aspect described above, due to numerous particles that are formed from thermoplastic resin being contained in the droplets, the resin is formed into a coating film when heated, and the film surface quality improves.

Because the present invention is structured as described above, blisters can be suppressed while deformation of the recording medium is reduced.

BRIEF DESCRIPTION OF THE DRAWINGS

An example of an exemplary embodiment relating to the present invention is described hereinafter with reference to the drawings.

DETAILED DESCRIPTION

Overall Structure

Figure 1:
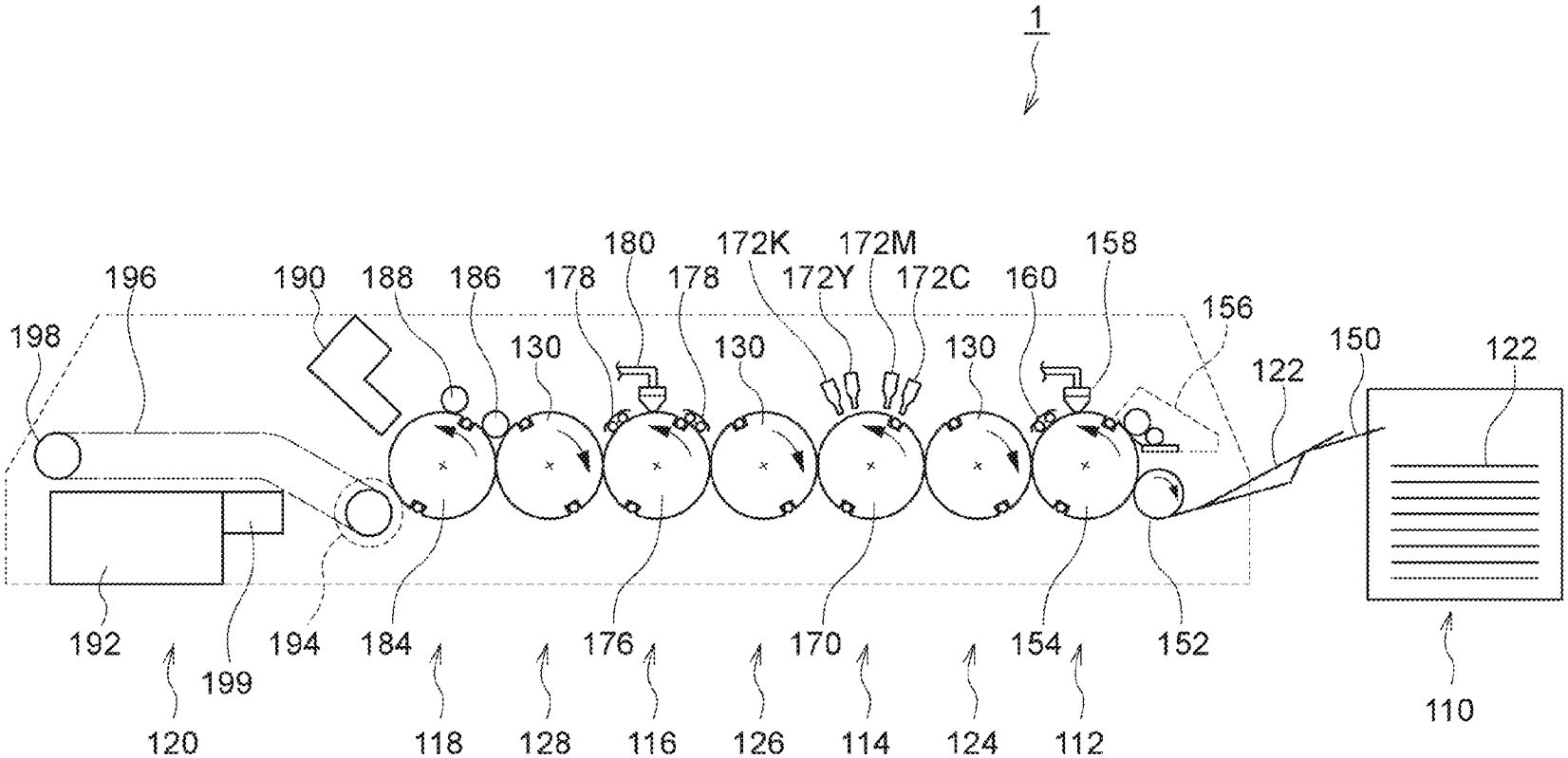
FIG. 1 is a schematic view showing the overall structure of an image recording device relating to an exemplary embodiment of the present invention.
Figure 2:
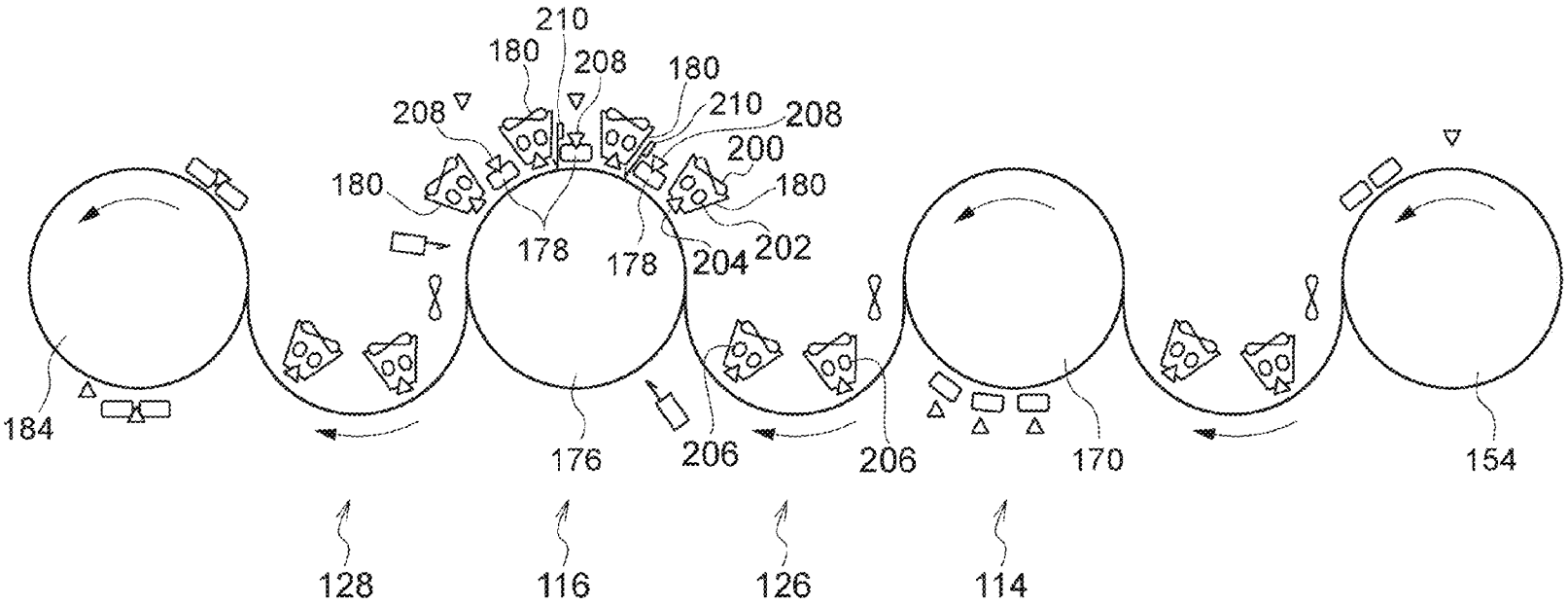
FIG. 2 is a schematic view showing main portions of the image recording device relating to the exemplary embodiment of the present invention.

An example of an inkjet-type image formation device for implementing an image formation method of the present embodiment is described hereinafter with reference to FIG. 1 and FIG. 2. FIG. 1 is a schematic view (side view) showing the whole device, and FIG. 2 is a schematic view (side view) that is drawn with emphasis on IR (infrared) heaters and warm air heaters.

An inkjet recording device 1 is an impression cylinder direct-drawing inkjet recording device that forms a desired color image by ejecting inks (droplets) of plural colors from inkjet heads 172M, 172K, 172C and 172Y that serve as examples of droplet ejecting devices, onto a sheet 122 that is held at an impression cylinder (image drawing drum 170) of an image drawing section 114. The inkjet recording device 1 is an on-demand type image formation device to which is applied a two-liquid reaction (agglomeration) method that carries out image formation on the sheet 122 by, before ejecting ink, applying a processing liquid (ink agglomerating processing liquid) onto the sheet 122 that serves as a recording medium, and causing the processing liquid and the inks to react.

The inkjet recording device 1 includes mainly a sheet feeding section 110, a processing liquid applying section 112, an image drawing section 114, a drying section 116, a fixing section 118, and a sheet discharging section 120.

The sheet feeding section 110 is a mechanism that feeds the sheet 112 to the processing liquid applying section 112. The sheets 112, which are cut paper, are stacked in the sheet feeding section 110. A sheet feed tray 150 is provided at the sheet feeding section 110, and the sheets 122 are fed one-by-one from the sheet feed tray 150 to the processing liquid applying section 112. In the inkjet recording device 1, plural types of the sheets 122 that have different paper types or sizes (media sizes) can be used as the sheets 122. Note that the present exemplary embodiment describes a case in which cut paper is used as the sheets 122.

The processing liquid applying section 112 is a mechanism that applies processing liquid to the recording surface of the sheet 122. The processing liquid contains a color material agglomerating agent that agglomerates the color material in the ink that is applied at the image drawing section 114. Separation of the ink into the color material and the solvent is promoted by the processing liquid and the ink contacting one another.

As shown in FIG. 1, the processing liquid applying section 112 has a sheet feeding cylinder 152, a processing liquid drum 154, and a processing liquid coating device 156. The processing liquid drum 154 is a drum that holds the sheet 122 and rotates and conveys the sheet 122. Claw-shaped holding units (grippers) are provided at the outer peripheral surface of the processing liquid drum 154, and the leading end of the sheet 122 can be held by the sheet 122 being nipped-in between the claws of the holding units and the peripheral surface of the processing liquid drum 154.

Suction holes may be provided in the outer peripheral surface of the processing liquid drum 154, and a suction unit for carrying out suction from the suction holes may be connected thereto. Due thereto, the sheet 122 can be held tightly to the peripheral surface of the processing liquid drum 154.

The processing liquid coating device 156 is provided at the outer side of the processing liquid drum 154 so as to face the peripheral surface thereof. The processing liquid coating device 156 includes a processing liquid container in which processing liquid is stored, an anilox roller of which a portion is immersed in the processing liquid in the processing liquid container, and a rubber roller that is pressed to and contacts with the anilox roller and the sheet 122 that is on the processing liquid drum 154 and transfers the processing liquid, after measurement thereof, onto the sheet 122. According to this processing liquid coating device 156, the processing liquid can be coated onto the sheet 122 while being measured. A warm air heater 158 and an IR heater 160, that dry the processing liquid coated on the sheet 122, are provided at the downstream side, in the conveying direction of the sheet 122, of the processing liquid coating device 156.

The sheet 122, to which the processing liquid has been applied at the processing liquid applying section 112, is transferred from the processing liquid drum 154 via an intermediate conveying section 124 (a transfer cylinder 130) to the image drawing drum 170 of the image drawing section 114. The image drawing section 114 has the image drawing drum 170 and the inkjet heads 172M, 172K, 172C and 172Y. In the same way as the processing liquid drum 154, the image drawing drum 170 has claw-shaped holding units (grippers) at the outer peripheral surface thereof. The sheet 122 that is fixed to the image drawing drum 170 is conveyed with the recording surface thereof facing outward, and inks are applied to this recording surface from the inkjet heads 172M, 172K, 172C and 172Y.

Each of the inkjet heads 172M, 172K, 172C and 172Y is a full-line-type inkjet recording head (inkjet head) having a length that corresponds to the maximum width of the image formation region at the sheet 122. Nozzle rows, at which plural nozzles for ejecting ink are arrayed, are formed at the ink ejecting surface of each of the inkjet heads 172M, 172K, 172C and 172Y, over the entire width of the image formation region. Each of the inkjet heads 172M, 172K, 172C and 172Y is set so as to extend in a direction orthogonal to the conveying direction of the sheet 122 (the rotating direction of the image drawing drum 170).

Droplets of inks of corresponding colors are ejected from the respective inkjet heads 172M, 172K, 172C and 172Y toward the recording surface of the sheet 122 that is held tightly on the image drawing drum 170. Due thereto, the inks contact the processing liquid, that was applied in advance to the recording surface at the processing liquid applying section 112, and the pigment and resin particles that are dispersed within the inks agglomerate, and agglomerates are formed. Flowing of pigment on the sheet 122, and the like, are thereby prevented, and an image is formed on the recording surface of the sheet 122.

The sheet 122, on which an image is formed at the image drawing section 114, is transferred from the image drawing drum 170 via an intermediate conveying section 126 to a drying drum 176 of the drying section 116. The drying section 116 is a mechanism that dries the moisture contained in the solvent that separated due to the agglomerating action. As shown in FIG. 1, the drying section 116 has the drying drum 176, and plural IR (infrared) heaters 178 and warm air heaters 180 disposed between the respective IR heaters 178, that serve as examples of heating devices described later.

In the same way as the processing liquid drum 154, the drying drum 176 has claw-shaped holding unit (grippers) at the outer peripheral surface thereof, and can hold the leading end of the sheet 122 by the holding units. The temperature and the air volume of the warm air that is blown-out from the warm air heaters 180 toward the sheet 122, and the temperatures of the respective IR heaters, are measured by temperature sensors, and are sent as temperature information to an unillustrated control section. Various drying conditions are realized due to the control section appropriately adjusting the temperature and the air volume of the warm air and the temperatures of the respective IR heaters on the basis of this temperature information.

Note that the surface temperature of the drying drum 176 may be set to greater than or equal to 50° C. By carrying out heating from the reverse surface of the sheet 122, drying is accelerated and image destruction at the time of fixing can be prevented. Note that the upper limit of the surface temperature of the drying drum 176 is not particularly limited, but is preferably set to less than or equal to 75° C. (and more preferably less than or equal to 60° C.) from the standpoint of safety (prevention of burns due to high temperatures) in maintenance work such as cleaning ink that has adhered to the surface of the drying drum 176 and the like.

Further, as mentioned above, it is known that there is less expansion and contraction of the sheet 122 at higher drying cylinder temperatures (surface temperatures of the drying drum 176) (i.e., with strong drying). Therefore, to the extent that the aforementioned safety is not adversely affected, higher surface temperatures of the drying drum 176 can suppress the effects of cockling.

Due to drying being carried out while the sheet 122 is rotated and conveyed while being held at the outer peripheral surface of the drying drum 176 with the recording surface of the sheet 122 facing outward (i.e., in a state in which the recording surface of the sheet 122 is curved so as to become the convex side), the occurrence of wrinkles and floating-up of the sheet 122 can be prevented, and uneven drying due thereto can be prevented.

The sheet 122, on which drying processing has been carried out at the drying section 116, is transferred from the drying drum 176 via an intermediate conveying section 128 to a fixing drum 184 of the fixing section 118. The fixing section 118 includes the fixing drum 184, a first fixing roller 186, a second fixing roller 188, and an in-line sensor 190.

In the same way as the processing liquid drum 154, the fixing drum 184 has claw-shaped holding units (grippers) at the outer peripheral surface thereof, and can hold the leading end of the sheet 122 by the holding units. Due to the rotation of the fixing drum 184, the sheet 122 is conveyed with the recording surface thereof facing outward, and fixing processing by the first fixing roller 186 and the second fixing roller 188, and inspection by the in-line sensor 190, are carried out on this recording surface.

The first fixing roller 186 and the second fixing roller 188 are roller members for welding the resin particles (in particular, self-dispersing polymer particles) within the inks and making the inks into a coating film by heating and pressurizing the inks, and are structured so as to heat and apply pressure to the sheet 122.

Concretely, the first fixing roller 186 and the second fixing roller 188 are disposed so as to press-contact the fixing drum 184, and serves as nip rollers together with the fixing drum 184. Due thereto, the sheet 122 is nipped between, on the one hand, the first fixing roller 186, the second fixing roller 188, and, on the other hand, the fixing drum 184, and is nipped at a predetermined nip pressure (e.g., 0.15 MPa), and fixing processing is carried out.

Further, the first fixing roller 186 and the second fixing roller 188 serve as heating rollers in which a halogen lamp is assembled within a pipe made of a metal having good thermoconductivity such as aluminum or the like, and are controlled to a predetermined temperature (e.g., 60 to 80° C.).

Due to the sheet 122 being heated by these heating rollers, thermal energy of greater than or equal to the energy required to make the temperature of the resin particles contained in the ink be the glass transition temperature (Tg) of the resin particles is applied, and the resin particles are fused. Due thereto, push-in fixing into the recesses and protrusions of the sheet 122 is carried out, and the unevenness of the surface of the image is leveled, and glossiness is obtained.

The in-line sensor 190 is a measuring unit that measures a check pattern and the moisture content, surface temperature, gloss level, and the like of the image fixed on the sheet 122, and a CCD line sensor or the like is used therefor.

Because the resin particles within the image layer, that is a thin layer formed at the drying section 116, are heated and pressurized and fused by the fixing rollers 186 and 188, the resin particles can be fixed to the sheet 122 by the fixing section 118. Further, due to the surface temperature of the fixing drum 184 being set to greater than or equal to 50° C. and the sheet 122, that is held at the outer peripheral surface of the fixing drum 184, being heated from the reverse surface, drying is accelerated, image destruction at the time of fixing can be prevented, and the image intensity can be increased by the effect of raising the image temperature.

As shown in FIG. 1, the sheet discharging section 120 is provided at the recording medium conveying direction downstream side of the fixing section 118. The sheet discharging section 120 has a discharge tray 192. A transfer cylinder 194, a conveying belt 196, and a tension roller 198 are provided between the discharge tray 192 and the fixing drum 184 of the fixing section 118, so as to face both of the tray 192 and the drum 184. The sheet 122 is sent to the conveying belt 196 by the transfer cylinder 194, and is discharged out to the discharge tray 192.

A cool air jetting nozzle 199 is also provided at the discharge tray 192, so that cooling of the sheet 122 can be carried out by cool air being blown from the cool air jetting nozzle 199.

Further, although not shown in FIG. 1, the inkjet recording device 1 has, in addition to the components described above, ink storage tanks that supply inks to the respective inkjet heads 172M, 172K, 172C and 172Y, and a unit that supplies the processing liquid to the processing liquid applying section 112. The inkjet recording device 1 also has maintenance sections that carry out cleaning (wiping of the nozzle surfaces, purging, suctioning of nozzles, and the like) of the respective inkjet heads 172M, 172K, 172C and 172Y, position detecting sensors that detect the position of the sheet 122 on the medium conveying path, temperature sensors that detect the temperatures of the respective sections of the device, and the like.

The inkjet recording device 1 shown in FIG. 1 may include plural seasoning devices that are used at the discharge tray 192, and the respective seasoning devices may move between the sheet discharging section 120 and the sheet feeding section 110.

Details of Drying Section

Details of the drying section 116 are shown in FIG. 2. As described above, the drying section 116 is a mechanism that dries the moisture contained in the solvent dispersed by the agglomerating action, and, as shown in FIG. 2, has the drying drum 176, the plural IR heaters 178, and the warm air heaters 180 that are disposed between the respective IR heaters 178.

The sheet 122 is transferred from the image drawing drum 170 via the intermediate conveying section 126 (the transfer cylinder 130) to the drying drum 176 of the drying section 116. In the present exemplary embodiment, the warm air heaters 180 and the IR heaters 178 are disposed alternately along the outer peripheral surface of the drying drum 176, and heat the drying drum 176 and the sheet 122 that is being conveyed.

For example, a halogen heater, which extends along the outer peripheral surface of the drying drum 176 with a predetermined distance therebetween, or the like, is used as the IR heater 178.

Further, the structure of the warm air heater 180 is such that, for example, hot air is sent toward the drying drum 176 due to a hot air heater 202 being disposed in the flow of air generated by an axial fan 200. A temperature sensor 204 may be provided in order to prevent heating at this time.

Plural temperature sensors 208, which detect the paper surface temperature of the sheet 122 conveyed by the drying drum 176, and plural optical moisture sensors 210, that detect the moisture content of the sheet 122 without contact, are provided along the peripheral surface of the drying drum 176 in the drying section 116. The optical moisture sensor 210 optically detects moisture by the reflection of infrared rays, and can detect the moisture content at high speed and in a non-contact manner. On the basis of the paper surface temperatures of the sheet 122 that are measured at the plural temperature sensors 208 and the moisture contents of the sheet 122 that are detected at the optical moisture sensors 210, the temperature and the air volume of the warm air that is blown-out from the warm air heaters 180 toward the sheet 122 and the temperatures of the respective IR heaters 178 are appropriately adjusted at an unillustrated control section.

Warm air heaters 206, that blow warm air out onto the recording surface of the sheet 122, may be provided at the intermediate conveying section 126 (the transfer cylinder 130). By providing the warm air heaters 206 at the intermediate conveying section 126 (the transfer cylinder 130), the moisture contained in the solvent dispersed by the agglomerating action can be dried immediately after the inks are ejected onto the sheet 122 by the inkjet heads 172M, 172K, 172C and 172Y.

Figure 3:
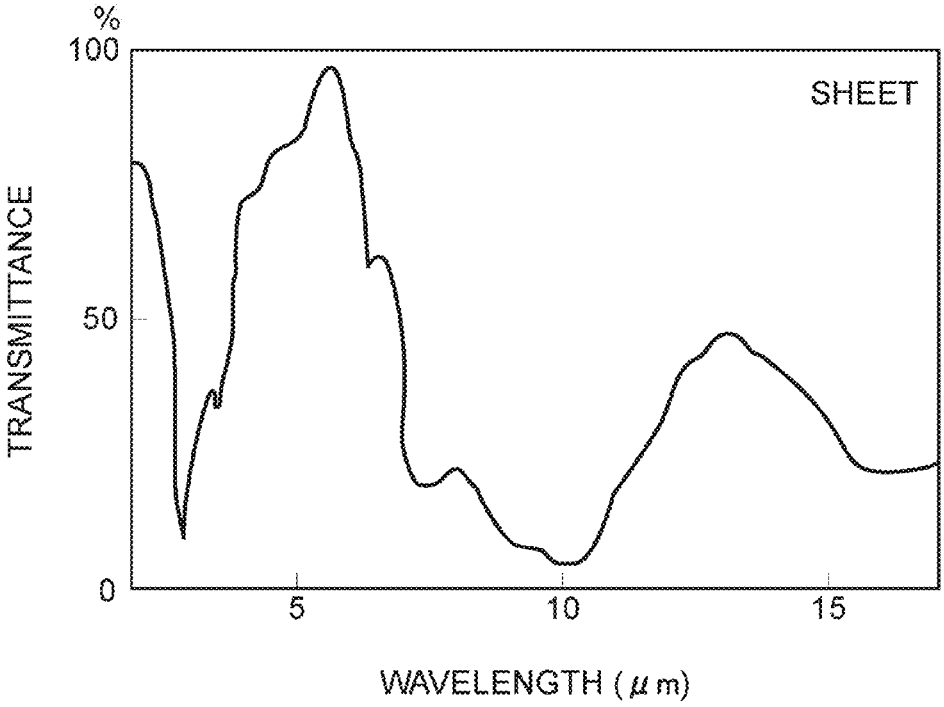
FIG. 3 is a graph showing the relationship between wavelength of an IR (infrared) heater and transmittance into a sheet.

Generally, thermal damage of the sheet 122 at the non-image portions is problematic when heating is carried out by IR heaters. Namely, the moisture contained in the sheet is volatilized by heating of the blank portions, and sheet shrinkage of the non-image portions occurs, and cockling (undulations) or wrinkles may be brought about. The relationship between the wavelength of the infrared heater and the transmittance into the sheet is shown in FIG. 3. As shown in FIG. 3, because the absorbance of the sheet 122 with respect to wavelengths of 1.5 μm to 3.0 μm is high, in the present exemplary embodiment, near infrared rays at which the peak wavelength of the infrared rays is less than or equal to 1.2 μm, and preferably around 0.7 μm to 1.2 μm, are used as the IR heaters 178. Due thereto, thermal damage of the sheet 122 by the IR heaters 178 can be reduced, and the occurrence of cockling and wrinkles can be reduced.

Further, by adjusting the peak wavelength of the IR heaters 178 and the temperature and the wind speed of the warm air that is blown-out from the warm air heaters 206 and the warm air heaters 180, in the initial stage of drying in which the moisture content derived from ink at the sheet 122 is greater than or equal to 4.0 g/m$^2$, heating is carried out under the condition that the paper surface temperature of the sheet 122 becomes less than or equal to 100° C. Further, after the moisture content derived from ink at the sheet 122 becomes lower than 4.0 g/m$^2$ (the later stage of drying), heating is carried out such that the paper surface temperature of the sheet 122 exceeds 100° C. Due thereto, cockling and wrinkles arising at the sheet 122 is reduced, and protrusions of the image surface that are called blisters (or burn blisters) arising at the sheet 122 is suppressed.

To describe the aforementioned drying conditions in further detail, in the initial stage of drying in which the moisture content derived from ink at the sheet 122 is greater than or equal to 4.0 g/m$^2$, heating is carried out under the condition that the paper surface temperature of the sheet 122 becomes less than or equal to 100° C. However, at the instant when the moisture content derived from ink at the sheet 122 becomes less than 4.0 g/m$^2$, there is no need for the paper surface temperature of the sheet 122 to exceed 100° C. Namely, it suffices for the paper surface temperature of the sheet 122 to exceed 100° C. after the moisture content derived from ink at the sheet 122 becomes less than 4.0 g/m$^2$.

Further, in the heating described above under the condition that the paper surface temperature of the sheet 122 becomes less than or equal to 100° C. in the initial stage of drying, the temperature (100° C.), at which the moisture that has penetrated into the sheet 122 evaporates, is set as the reference. Namely, when the moisture that has penetrated into the sheet 122 is evaporated suddenly in the initial stage of drying, it becomes easy for blisters (or burn blisters) to arise. Therefore, by making the paper surface temperature of the sheet 122 be less than or equal to 100° C., evaporating of the moisture is suppressed.

In the present exemplary embodiment, as described above, the paper surface temperature of the sheet 122 is measured at the plural temperature sensors 208, and the moisture content of the sheet 122 is detected at the optical moisture sensors 210, and the moisture content that the sheet 122 held before printing, that is stored in an unillustrated controller in advance as data, is subtracted so as to detect the moisture content derived from ink. Further, on the basis of the paper surface temperature of the sheet 122 and the moisture content of the sheet 122, the temperature and the air volume of the warm air that is blown-out from the warm air heaters 180 toward the sheet 122, and the temperatures of the respective IR heaters 178, are appropriately adjusted by the unillustrated control section, and drying conditions described above are thereby realized. For example, halogen heaters at which the peak wavelength of infrared rays is 1.2 μm are used as the IR heaters 178. Further, at the warm air heaters 180 and 206, for example, the temperature of the warm air is set to 70° C. and the wind speed is set to 5 msec, and the temperature and the wind speed of the warm air can be adjusted.

At the image drawing section 114, numerous particles formed from thermoplastic resin may be added into the inks that are ejected from the inkjet heads 172. By adding particles that are formed from thermoplastic resin into the inks, the resin being formed into a coating film by the heating and drying process can be expected, and the addition of such particles is effective in ensuring the film surface quality. In this case, preferable effects are obtained by heating the film surface from 100° C. to 120° C., although it depends also on the coating film formation temperature of the particles formed from thermoplastic resin.

Range of Applicable Sheets

The image formation device 1 of the present exemplary embodiment can obtain particularly preferable results when a general-purpose coated paper for printing applications that has low air permeability is used as the sheet 122.

Examples of support members that can be used in coated papers are: base paper whose main components are pigment and wood pulp such as chemical pulp like LBKP, NBKP or the like, mechanical pulp such as GP, PGW, RMP, TMP, CTMP, CMP, CGP or the like, waste paper pulp such as DIP or the like, and the like. In the base paper a binder and one or more types of various additives, such as a sizing agent, a fixing agent, a retention aid, a cationization agent, a paper strength agent, and the like, are mixed together. The base paper is manufactured by using any of various devices such as a Fourdrinier papermaking machine, a vat papermaking machine, a twin-wire papermaking machine or the like. Another example of support members is base paper provided with a size press or anchor coat layer using starch, polyvinyl alcohol, or the like. Also in examples of support members are coating-processed papers such as art paper, coated paper, cast coated paper or the like provided with a coating layer on such a size press or anchor coat layer; and the like.

The base weight of the support is usually around 40 to 300 g/m$^2$, but is not limited in particular. In the coated paper that is used in the present invention, a coating layer is applied on a support such as described above. The coating layer is formed from a coating composition whose main components are pigment and binder, and at least one coating layer is applied onto the support.

White pigments can be used as the aforementioned pigment. Examples of white pigments are: inorganic pigments such as light calcium carbonate, heavy calcium carbonate, magnesium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, alumina, colloidal alumina, pseudoboehmite, aluminum hydroxide, lithopone, zeolite, hydrated halloysite, magnesium hydroxide, and the like; and organic pigments such as styrene-based plastic pigments, acryl-based plastic pigments, polyethylene, microcapsules, urea resins, melamine resins, and the like.

Examples of the aforementioned binder are: starch derivatives such as oxidized starch, etherified starch, starch phosphate; cellulose derivatives such as carboxymethyl cellulose, hydroxyethyl cellulose, and the like; casein, gelatin, soybean protein, polyvinyl alcohol and derivatives thereof; polyvinyl alcohols of various saponification degrees and various types of derivatives thereof such as silanol modified products, carboxylated products, cationized products, and the like; conjugated diene copolymer latex such as polyvinylpyrrolidone, maleic anhydride resin, styrene-butadiene copolymer, methyl methacrylate-butadiene copolymer, and the like; acryl-based polymer latex such as polymers and copolymers and the like of acrylic acid esters and methacrylic acid esters; vinyl-based polymer latex such as ethylene vinyl acetate copolymer and the like; or a functional group modified polymer latex of these various types of polymers that is obtained by modification by a functional group-containing monomer that contains a functional group such as a carboxy group or the like; aqueous adhesives such as thermosetting synthetic resins such as melamine resin, urea resin and the like, or the like; acryls such as polymethyl methacrylate or the like; ester acids; polymer or copolymer resins of methacrylic acid esters; synthetic resin adhesives of polyurethane resin, unsaturated polyester resin, vinyl chloride-vinyl acetate copolymer, polyvinyl butyral, alkyd resin, and the like; and the like.

The compounding ratio of the pigment and binder of the coating layer is 3 to 70 parts by weight, and preferably 5 to 50 parts by weight, of the binder with respect to 100 parts by weight of the pigment. If the compounding ratio of the binder with respect to 100 parts by weight of the pigment is less than 3 parts by weight, the coated film strength of the ink receiving layer formed from such a coating composition may be insufficient. On the other hand, if this compounding ratio exceeds 70 parts by weight, the absorption of high boiling point solvents becomes very slow.

Further, various types of additives can be appropriately compounded in the coating layer such as, for example, dye fixing agents, pigment dispersing agents, thickeners, flowability improving agents, defoaming agents, foaming inhibitors, mold releasing agents, foaming agents, penetrants, coloring dyes, coloring pigments, fluorescent brightening agents, ultraviolet absorbers, antioxidants, preservatives, antifungal agents, water resistant additive, wet paper strength additive, dry paper strength additive, and the like.

The coated amount of the ink receiving layer cannot be specified unequivocally as it differs in accordance with the required gloss, ink absorbency, type of support member, and the like, but is usually greater than or equal to 1 g/m$^2$. Further, the ink receiving layer may be formed by applying a given coated amount each of two times. By carrying out application in two times in this way, the gloss improves as compared with a case in which the same coated amount is applied at a single time.

The application of the coating layer can be carried out, on-machine or off-machine, by using any of various types of devices such as, for example, various types of blade coaters, roll coaters, air knife coaters, bar coaters, rod blade coaters, curtain coaters, short dowell coaters, size presses, and the like. Further, after applying the coating layer, smoothing finishing of the ink receiving layer may be carried out by using a calender device such as, for example, a machine calender, a TG calender, a soft calender, or the like. Note that the number of coating layers can be determined appropriately as needed.

Examples of the coated paper are art paper, high-grade coated paper, medium-grade coated paper, high-grade lightweight coated paper, medium-grade lightweight coated paper, and lightly coated printing paper. The coated amount of the coating layer is around 40 g/m$^2$ on both surfaces in the case of art paper, around 20 g/m$^2$ on both surfaces in the case of high-grade coated paper and medium-grade coated paper, around 15 g/m$^2$ on both surfaces in the case of high-grade lightweight coated paper and medium-grade lightweight coated paper, and less than or equal to 12 g/m$^2$ on both surfaces in the case of lightly coated printing paper. Examples of art paper are TOKUBISHI ART and the like. An example of high-grade coated paper is U-LITE. Examples of art paper are TOKUBISHI ART (manufactured by Mitsubishi Paper Mills, Ltd.), SATIN KINFUJI (manufactured by Oji Paper Co., Ltd.), and the like. Examples of coated paper are OK TOP COAT (manufactured by Oji Paper Co., Ltd.), AURORA COAT (manufactured by Nippon Paper Industries co., Ltd.), and RECYCLE COAT T-6 (manufactured by Nippon Paper Industries co., Ltd.). Examples of lightweight coated paper are U-LITE (manufactured by Nippon Paper Industries co., Ltd.), NEW V MATT (manufactured by Mitsubishi Paper Mills, Ltd.), NEW AGE (manufactured by Oji Paper Co., Ltd.), RECYCLE MAT T-6 (manufactured by Nippon Paper Industries co., Ltd.), and PISMMAT (manufactured by Nippon Paper Industries co., Ltd.). Examples of lightly coated printing paper are AURORA L (manufactured by Nippon Paper Industries co., Ltd.), KINMARI HI-L (manufactured by Hokuetsu Paper Mills, Ltd.), and the like. Moreover, examples of cast coated paper are SA KINFUJI PLUS (manufactured by Oji Paper Co., Ltd.), HI-MCKINLEY ART (manufactured by Gojo Paper Mfg., Co., Ltd.), and the like.

Operation/Effects

As shown in FIG. 1, the sheet 122 that is fed from the sheet feeding section 110 is conveyed along the outer peripheral surfaces of the sheet feed cylinder 152 and the processing liquid drum 154 that rotate. At the processing liquid applying section 112, the processing liquid coating device 156 coats a processing liquid (an ink agglomerating processing liquid) onto the recording surface of the sheet 122 that is conveyed along the outer peripheral surface of the processing liquid drum 154.

The sheet 122, on which the processing liquid has been coated, is conveyed, via the intermediate conveying section 124, along the outer peripheral surface of the image drawing drum 170. At the image drawing section 114, the inkjet heads 172M, 172K, 172C and 172Y of the respective colors eject droplets (inks) onto the recording surface of the sheet 122 that is conveyed by the image drawing drum 170, and form an image on the sheet 122. At this time, the inks contact the processing liquid, which was applied in advance onto the recording surface at the processing liquid applying section 112, and the pigments and resin particles that are dispersed within the inks agglomerate, and agglomerates are formed. Due thereto, flowing of pigments on the sheet 122, and the like, are prevented, and an image is formed on the recording surface of the sheet 122.

Further, the sheet 122, on whose recording surface an image has been formed, is, via the intermediate conveying section 126, conveyed along the outer peripheral surface of the drying drum 176. Due to warm air being blown-out from the warm air heaters 206 onto the recording surface of the sheet 122 at the intermediate conveying section 126, the moisture contained in the sheet 122 after ink ejection is dried (the moisture included in the solvent separated by the agglomerating action is decreased). At the drying section 116, due to the heat of the IR heaters 178 and the warm air that is blown-out from the warm air heaters 180, the moisture contained in the sheet 122 that is conveyed by the drying drum 176 after ink ejection is dried (the moisture included in the solvent separated by the agglomerating action is decreased).

The sheet 122, whose temperature has become high due to the heat of the IR heaters 178 and the warm air blown-out from the warm air heaters 180, is conveyed, via the intermediate conveying section 128, along the outer peripheral surface of the fixing drum 184. At the fixing section 118, due to the sheet being contacted under pressure with the fixing drum 184 and the first fixing roller 186 and the second fixing roller 188, the image formed on the sheet 122 is fixed onto the sheet 122. Further, the sheet 122 passes by the portion facing the in-line sensor 190, and the check pattern on the sheet 122 that passes by, as well as the moisture content, the surface temperature, the gloss level and the like are measured.

The sheet 122 that has been examined by the in-line sensor 190 is conveyed by the transfer cylinder 194 and the conveying belt 196, and the discharged out to the discharge tray 192.

Here, when the sheet 122 is dried at the drying section 116 after image formation (when the moisture of the sheet 122 decreases), cockling (undulations) may arise at the sheet 122 due to the difference in the moisture contents at the image portions, where the moisture of the droplets exists, and the non-image portions, where moisture of droplets does not exist.

Namely, if the sheet 122 is left to stand in the atmosphere (the exterior of the inkjet recording device 1), even if the drying strengths (the degrees of strength of drying the sheet 122) differ, the moisture contents of the image-drawn portions settle to a predetermined value. However, the moisture contents of the non-image-drawn portions are values that differ in accordance with the magnitude of the drying strength. As a result, the stronger the drying strength at the interior of the inkjet recording device 1, the greater the difference in the moisture contents at the image portions and the non-image portions, and the cockling may be worse.

Further, when general-purpose coated paper that is used in offset printers or the like is used as the sheet 122, protrusions of the image surface called blisters may arise. This is thought to be due to the fact that general-purpose coated paper has lower air permeability (air permeability of 5000 seconds to 20,000 seconds) than high-grade paper, and, when the moisture that has penetrated into the sheet 122 is evaporated by heat, there is no place for the moisture to escape to, and the moisture causes the film surface to protrude.

In contrast, in the present exemplary embodiment, near-infrared rays of which the peak wavelength is less than or equal to 1.2 μm, and preferably around 0.7 μm to 1.2 μm, are used as the IR heater 178. Due thereto, thermal damage of the sheet 122 due to the IR heaters 178 can be reduced, and cockling (undulations) and wrinkles that arise at the sheet 122 can be reduced (see FIG. 2).

Further, by adjusting the peak wavelength of the IR heaters 178 and the temperature and wind speed of the warm air blown-out from the warm air heaters 206 and the warm air heaters 180, during the initial stage of drying in which the moisture content derived from ink at the sheet 122 is greater than or equal to 4.0 g/m$^2$, heating is carried out under the condition that the paper surface temperature of the sheet 122 becomes less than or equal to 100° C. Further, after the moisture content derived from ink at the sheet 122 becomes less than 4.0 g/m$^2$ (the later stage of drying), heating is carried out such that the paper surface temperature of the sheet 122 exceeds 100° C. Due thereto, thermal damage to the sheet 122 can be reduced, and cockling and wrinkles arising at the sheet 122 can reduced. Together therewith, sudden evaporation, due to heating, of the moisture that has penetrated into the sheet 122 is suppressed, and the occurrence of protrusions of the image surface called blisters at the sheet 122 can be suppressed.

Moreover, by adding numerous particles formed from thermoplastic resin into the droplets (inks) that are ejected from the inkjet heads 172M, 172K, 172C and 172Y, the resin being formed into a coating film by the heating and drying process can be expected, and the addition of such particles is effective for ensuring the film surface quality. In this case, preferable effects are obtained by heating the film surface to 100° C. to 120° C., although it depends also on the coating film formation temperature of the particles formed from thermoplastic resin.

EXAMPLES

Evaluation was carried out in accordance with the following Examples in order to evaluate the moisture content, the occurrence of blisters and the occurrence of cockling at the time of drying by the image formation device of the present invention.

Image Formation Device for Evaluation

Figure 4:
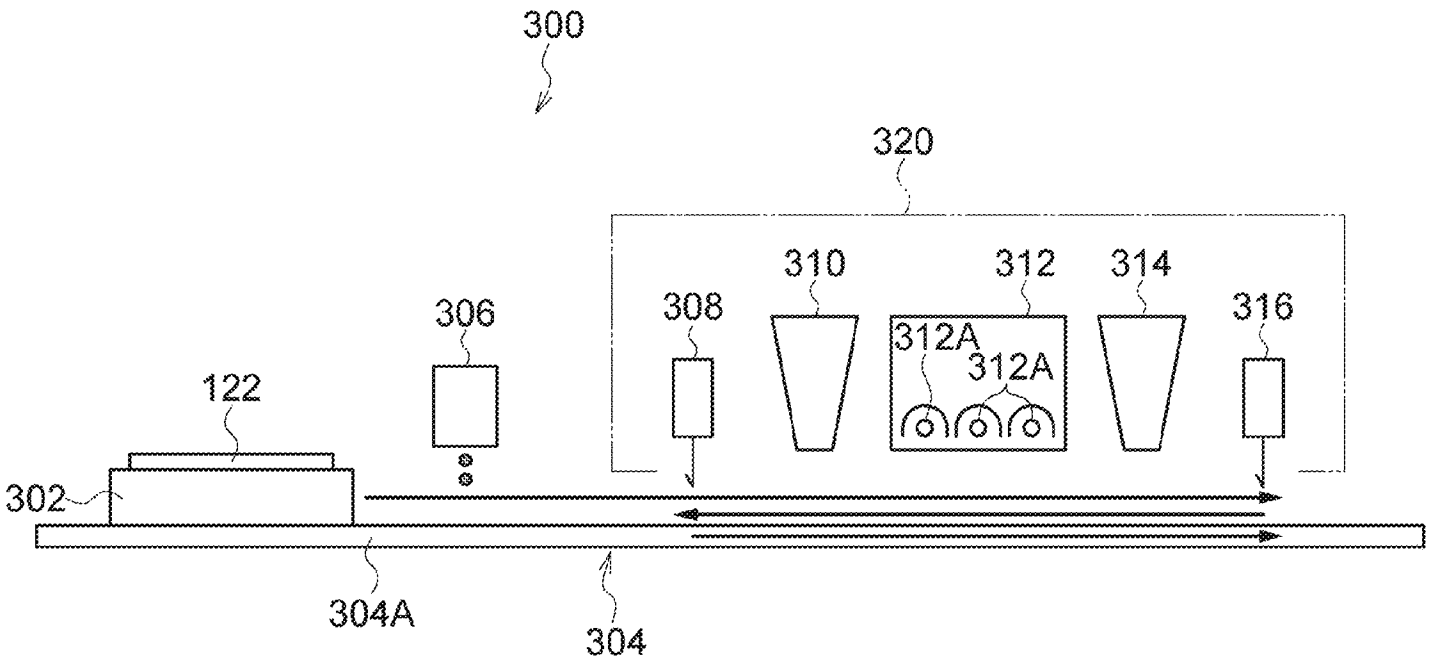
FIG. 4 is a block diagram showing an image formation device for evaluation, for carrying out evaluation of drying conditions.

An image formation device 300 for evaluating the moisture content, the occurrence of blisters and the occurrence of cockling of papers at the time of drying is shown in FIG. 4. As shown in FIG. 4, the image formation device 300 includes: a stage 302, of which the top surface holds and coveys the sheet 122; a moving device 304 that moves the stage 302 along a guiding portion 304A by an unillustrated driving unit; an inkjet head 306 that ejects ink onto the recording surface of the sheet 122, in order from the upstream side toward the downstream side in the moving direction of the stage 302; a first measuring portion 308 that measures the temperature and the moisture content of the sheet 122; a warm air heater 310 that blows warm air out onto the recording surface of the sheet 122; a drying device 312 having plural IR heaters 312A that dries moisture contained within the sheet 122; a warm air heater 314 that blows warm air out onto the recording surface of the sheet 122; and a second measuring portion 316 that measures the temperature and the moisture content of the sheet 122. The range in which the first measuring portion 308, the warm air heater 310, the IR heaters 312A, the warm air heater 314, and the second measuring portion 316 are disposed is a drying section 320.

The stage 302 on which the sheet 122 is held is moved by the moving device 304, and ink is ejected onto the sheet 122 by the inkjet head 306. Thereafter, the stage 302 is moved along the drying section 320 up to a position facing the second measuring portion 316. The stage 302 is moved in the order of the first measuring portion 308, the warm air heater 310, the IR heaters 312A, the warm air heater 314, and the second measuring portion 316. Thereafter, the stage 302 on which the sheet 122 is held is returned along the drying section 320 to the first measuring portion 308, and further, the operation of moving the stage 302 along the drying section 320 to the second measuring portion 316 is repeated. Namely, after ink ejection, the sheet 122 is reciprocally moved (reciprocally scanned) along the drying section 320. In the present exemplary embodiment, the sheet 122, after ink ejection by the inkjet head 306, being moved along the drying section 320 to the second measuring portion 316 is counted as "1 pass", and thereafter, the sheet 122 being returned along the drying section 320 to the first measuring portion 308 is counted as "2 pass". Further, the sheet 122 moving along the drying section 320 to the second measuring portion 316 is counted as "3 pass", and similarly, the number of passes is successively incremented in this way.

Printed Sample for Evaluation

Figure 5:
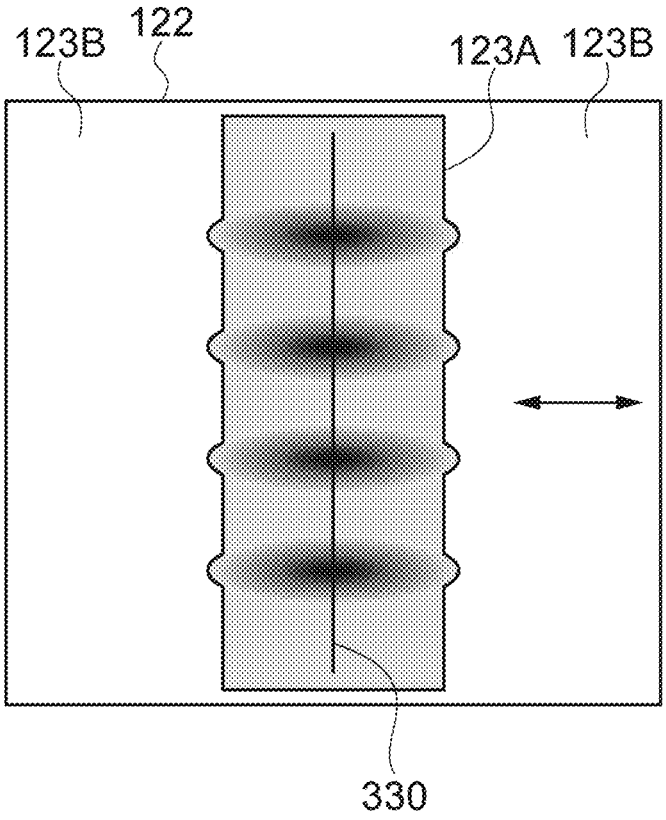
FIG. 5 is a drawing showing a printed sample at the time of carrying out evaluation by ejecting ink onto a sheet.

As shown in FIG. 5, at a printed sample for evaluation, a portion 123A hit by ink that serves as an image portion is formed over the entire paper width at the central portion with respect to the paper fiber direction (the grain direction), that is shown by the arrow, of the sheet 122, and portions 123B not hit by ink serving as non-image portions are provided at the both sides thereof. The sheet 122 has a sheet size of 150 mm square, and the image size is of a width of 50 mm and a length of 140 mm.

Experiment Conditions

The experiment conditions were set as follows.

sheet: coated sheet, manufactured by Oji Paper Co., Ltd., OK TOPCOAT+, 104.7 g/m$^2$ ink: black (as described in the Examples)

ink hitting: 1200×1200 dpi, droplet amount 6 pL densely covering the entire surface (ink hit amount: 13.0 g/m$^2$, moisture content in ink: 10.4 g/m$^2$)

stage conveying speed: 500 mm/sec

IR heater: manufactured by Ushio Inc., halogen heater QIR100V-500/L

: manufactured by Heraeus KK, carbon heater CRS100/300G warm air heater: blower, wind speed: 5 msec, air temperature: 70° C.

temperature measurement: Keyence FT-020 moisture content measurement: Karl Fischer method precoating: precoating liquid recited in Examples (ink agglomerating processing liquid)

precoating hitting: 1200×1200 dpi, droplet amount: 2 pL, 50% hitting (precoat applied amount: 2.2 g/m$^2$)

After application of the precoating liquid, 2 pass scanning was carried out at the aforementioned conveying speed, and drying was carried out by using the warm air heaters (blowers).

Method of Measuring Moisture Content

The moisture content that the sheet 122 contains is measured by punching out a 3 cm×3 cm size portion to be measured of the sheet 122, and using a device for measuring trace amounts of moisture CA-200 (manufactured by Mitsubishi Chemical Analytech Co., Ltd.). The measured moisture content [g] is divided by the punched-out surface area, and the moisture content per unit surface area [g/m$^2$] is computed. Here, the moisture content that the sheet 122 held before printing is separately measured in advance, and by subtracting this, the moisture content derived from ink is expressed.

Method of Evaluating Blisters

The printed sample is observed by the naked eye and under an optical microscope, and the absence/presence of protrusions of the film surface is judged. Blisters are evaluated as B when protrusions of the film surface are not recognized, and as D when protrusions of the film surface are recognized (also including the state in which the top portion of the protrusion is broken).

Method of Evaluating Cockling

The displacement profile in the z direction (upper vertical direction) of the sheet 122 after printing is measured at 150 mm sections of a measurement place 330 of the printed sample shown in FIG. 5. The laser displacement sensor LK-080 manufactured by Keyence Corporation was used in measurement. The measured displacement profile value is path-integrated, and the horizontal distance is subtracted, and the amount of increase in profile length due to cockling is thereby measured. This is called the cockling amount. The cockling amount is evaluated as A when less than 0.05 mm, as B when less than 0.10 mm, as C when less than 0.20 mm, and as D when greater than or equal to 0.20 mm.

Evaluation Conditions

As shown in Table 1, testing was carried out by setting the structure of the IR heaters 312A to condition 1 through condition 9. Under all of the conditions, the total amount of irradiated energy of the IR heaters 312A was constant.

TABLE 1

| | heater structure | voltage applied to heater | peak wavelength | number of heaters | electric power density [W/mm] per 1 pass | number of passes |
|---|---|---|---|---|---|---|
| condition 1 | halogen heater | 165 V | 1.0 μm | 3 | 40 | 2 passes |
| condition 2 | halogen heater | 165 V | 1.0 μm | 2 | 20 | 4 passes |
| condition 3 | halogen heater | 165 V | 1.0 μm | 1 | 10 | 6 passes |
| condition 4 | halogen heater | 100 V | 1.2 μm | 9 | 40 | 2 passes |
| condition 5 | halogen heater | 100 V | 1.2 μm | 6 | 20 | 4 passes |
| condition 6 | halogen heater | 100 V | 1.2 μm | 3 | 10 | 6 passes |
| condition 7 | carbon heater | 100 V | 2.0 μm | 9 | 40 | 2 passes |
| condition 8 | carbon heater | 100 V | 2.0 μm | 6 | 20 | 4 passes |
| condition 9 | carbon heater | 100 V | 2.0 μm | 3 | 10 | 6 passes |

Evaluation Results

Paper surface temperature T of the sheet 122, the results of measurement of moisture content W derived from ink at the sheet 122, and the results of evaluation of cockling and blisters, at the time when experiments were carried out under condition 1 through condition 9, are shown in Table 2.

TABLE 2

| | Evaluation Results | | | | | | | | | | | | | |
|---|---|---|---|---|---|---|---|---|---|---|---|---|---|---|
| | paper surface temperature/moisture content | | | | | | | | | | | | | |
| | 1$^{st}$ pass | | 2$^{nd}$ pass | | 3$^{rd}$ pass | | 4$^{th}$ pass | | 5$^{th}$ pass | | 6$^{th}$ pass | | evaluation results | |
| | T [° C.] | W [g/m$^2$] | T [° C.] | W [g/m$^2$] | T [° C.] | W [g/m$^2$] | T [° C.] | W [g/m$^2$] | T [° C.] | W [g/m$^2$] | T [° C.] | W [g/m$^2$] | cockling | blisters |
| condition 1 | 121 | 4.1 | 138 | 1.1 | | | | | | | | | A | D |
| condition 2 | 63 | 5.2 | 85 | 4.0 | 114 | 2.8 | 125 | 1.0 | | | | | A | B |
| condition 3 | 45 | 6.9 | 60 | 5.7 | 71 | 4.3 | 82 | 3.1 | 87 | 1.9 | 93 | 1.0 | C | B |
| condition 4 | 108 | 4.4 | 127 | 1.3 | | | | | | | | | B | D |
| condition 5 | 61 | 5.4 | 82 | 4.0 | 103 | 3.0 | 116 | 1.2 | | | | | B | B |

TABLE 2-continued

| Evaluation Results | | | | | | | | | | | | | | |
|---|---|---|---|---|---|---|---|---|---|---|---|---|---|---|
| | paper surface temperature/moisture content | | | | | | | | | | | | | |
| | 1st pass | | 2nd pass | | 3rd pass | | 4th pass | | 5th pass | | 6th pass | | | |
| | T [° C.] | W [g/m²] | T [° C.] | W [g/m²] | T [° C.] | W [g/m²] | T [° C.] | W [g/m²] | T [° C.] | W [g/m²] | T [° C.] | W [g/m²] | evaluation results cockling | evaluation results blisters |
| condition 6 | 43 | 7.0 | 57 | 5.8 | 70 | 4.3 | 81 | 3.3 | 87 | 2.0 | 91 | 1.1 | D | B |
| condition 7 | 116 | 4.3 | 131 | 1.2 | | | | | | | | | D | D |
| condition 8 | 61 | 5.5 | 82 | 3.9 | 106 | 3.1 | 118 | 1.2 | | | | | D | B |
| condition 9 | 43 | 7.0 | 59 | 5.8 | 72 | 4.4 | 82 | 3.2 | 89 | 1.9 | 92 | 1.1 | D | B |
| condition 4 with precoating | 107 | 4.4 | 128 | 1.4 | | | | | | | | | A | D |
| condition 5 with precoating | 61 | 5.4 | 82 | 4.0 | 103 | 3.0 | 116 | 1.2 | | | | | A | B |
| condition 6 with precoating | 42 | 7.0 | 57 | 5.8 | 71 | 4.3 | 81 | 3.3 | 87 | 1.9 | 91 | 1.1 | C | B |

As shown in Table 2, under conditions 2, 5 and condition 5 with precoating, in the initial stage of drying in which the moisture content derived from ink at the sheet 122 is greater than or equal to 4.0 g/m$^2$, heating is carried out under the condition that the paper surface temperature of the sheet 122 becomes less than or equal to 100° C. After the moisture content derived from ink at the sheet 122 becomes lower than 4.0 g/m$^2$ (the later stage of drying), heating is carried out such that the paper surface temperature of the sheet 122 exceeds 100° C. According to these heating conditions, the occurrence of cockling and wrinkles at the sheet 122 can be reduced, and the occurrence of protrusions of the image surface that are called blisters can be suppressed.

Under conditions 1, 4 and condition 4 with precoating, in the initial stage of drying in which the moisture content derived from ink at the sheet 122 is greater than or equal to 4.0 g/m$^2$, heating is carried out under the condition that the paper surface temperature of the sheet 122 becomes higher than 100° C. Under this heating condition, the occurrence of cockling can be reduced, but blisters arise at the sheet 122. This is thought to be because, due to the paper surface temperature of the sheet 122 in the initial stage of heating becoming high, the moisture that has penetrated into the sheet 122 is evaporated suddenly by the heating and has no place to escape, and blisters arise.

Under conditions 3, 6, 9 and condition 6 with precoating, even after the moisture content derived from ink at the sheet 122 becomes less than 4.0 g/m$^2$ (the later stage of drying), heating is carried out under the condition that the paper surface temperature of the sheet 122 becomes less than 100° C. Under this heating condition, it is easy for cockling and wrinkles to arise at the sheet 122. This is thought to be because it takes time until the sheet 122 is dried, and a difference arises in the drying states at the ink hit portions and the ink non-hit portions of the sheet 122.

Under conditions 7 through 9, by using IR heaters at which the peak wavelength of the infrared rays is set to be 2.0 μm, the thermal damage to the sheet 122 is great, and it is easy for cockling and wrinkles to arise. On the other hand, under conditions 1, 2, 4, 5, by using IR heaters at which the peak wavelength of the infrared rays is set to be 1.0 μm or 1.2 μm, thermal damage to the sheet 122 is reduced, and the occurrence of cockling and wrinkles can be reduced.

Further, as shown by conditions 4 through 6 with precoating, by carrying out precoating by the ink agglomerating processing liquid, more preferable effects with respect to cockling are obtained. This is thought to be because, due to the pigment within the ink agglomerating, capillary force acts on the moisture within the image film surface, and penetration of moisture into the sheet 122 is suppressed.

Other Points

Although Examples of the present invention are described above, the present invention is not limited in any way to the above-described examples, and can, of course, be implemented in various forms within a scope that does not deviate from the gist of the present invention.

For example, although an inkjet image formation device that uses aqueous ink that uses water as a solvent is given as an example in the above-described embodiment, the liquid that is ejected is not limited to ink for image recording or character printing or the like, and the present invention can be applied to various ejected liquids provided that they are liquids using a solvent or a dispersion medium that penetrates into a recording medium.

What is claimed is:

1. An image formation device comprising:

a droplet ejecting device that ejects droplets onto a recording medium; and a drying device that dries the droplets ejected onto the recording medium, the drying device comprising an infrared heater at which a peak wavelength of infrared rays is set to be less than or equal to 1.2 μm; wherein:

A) during a first stage of drying, using the drying device, in which a moisture content, derived from the droplets, at the recording medium is greater than or equal to 4.0 g/m$^2$, heating is carried out under a condition that a paper surface temperature of the recording medium becomes less than or equal to 100° C., at which the moisture content that has penetrated into the recording medium evaporates; and B) during a second stage of drying, using the drying device, after the moisture content, derived from the droplets, at the recording medium becomes lower than 4.0 g/m$^2$, heating is carried out such that the paper surface temperature of the recording medium exceeds 100° C.

2. The image formation device of claim 1, wherein the recording medium comprises a general-purpose coated paper for printing applications.

3. The image formation device of claim 1, wherein the droplets are ink, and an ink agglomerating processing liquid is applied to the recording medium before the droplets are ejected onto the recording medium.

4. The image formation device of claim 1, wherein the droplets comprise a plurality of particles formed from thermoplastic resin.

5. The image formation device of claim 1, wherein:

the drying device includes a plurality of the infrared heaters and warm air heaters; and the image formation device further comprises:

a plurality of moisture sensors that detect the moisture content, derived from the droplets, at the recording medium; and a control section that adjusts the temperature of the respective infrared heaters and warm air heaters based on the moisture content detected by the respective moisture sensors.

6. An image formation method comprising:

ejecting droplets onto a recording medium; and a drying process whereby the droplets ejected onto the recording medium are exposed to an infrared heater at which a peak wavelength of infrared rays is set to be less than or equal to 1.2 μm, wherein the drying process comprises:

A) during a first stage of drying in which a moisture content, derived from the droplets, at the recording medium is greater than or equal to 4.0 $g/m^2$, carrying out heating under a condition that a paper surface temperature of the recording medium becomes less than or equal to 100° C., at which the moisture content that has penetrated into the recording medium evaporates; and B) during a second stage of drying, after the moisture content, derived from the droplets, at the recording medium becomes lower than 4.0 $g/m^2$, carrying out heating such that the paper surface temperature of the recording medium exceeds 100° C.

7. The image formation method of claim 6, wherein the recording medium comprises a general-purpose coated paper for printing applications.

8. The image formation method of claim 6, wherein the droplets are ink, and an ink agglomerating processing liquid is applied to the recording medium before the droplets are ejected onto the recording medium.

9. The image formation method of claim 6, wherein the droplets comprise a plurality of particles formed from thermoplastic resin.

10. The image formation method of claim 6, wherein:

the moisture content, derived from the droplets, at the recording medium is detected by a plurality of moisture sensors; and the droplets ejected onto the recording medium are dried by a plurality of the infrared heaters and warm air heaters; and the drying process comprises adjusting the temperature of the respective infrared heaters and warm air heaters based on the moisture content detected by the respective moisture sensors.

* * * * *